US007387055B2

(12) United States Patent
Liu

(10) Patent No.: US 7,387,055 B2
(45) Date of Patent: Jun. 17, 2008

(54) ACCOMMODATING HANDLE FOR HEXAGON SPANNER

(76) Inventor: Yi-Feng Liu, No. 7, Lane56, Zhongzheng Rd., Xinzhuang City, Taipei County (TW)

( * ) Notice: Subject to any disclaimer, the term of this patent is extended or adjusted under 35 U.S.C. 154(b) by 0 days.

(21) Appl. No.: 11/599,292

(22) Filed: Nov. 15, 2006

(65) Prior Publication Data

US 2008/0110302 A1 May 15, 2008

(51) Int. Cl.
*B25B 23/00* (2006.01)
*B25B 23/16* (2006.01)

(52) U.S. Cl. ..... 81/440; 81/177.1; 81/177.6; 81/177.4

(58) Field of Classification Search ..... 81/440, 81/439, 177.4, 177.6, 177.1, 489, 490
See application file for complete search history.

(56) References Cited

U.S. PATENT DOCUMENTS 5,186,083 A * 2/1993 Hsiao ..... 81/124.4
5,365,811 A * 11/1994 Chi ..... 81/439
5,713,252 A * 2/1998 Iwinski et al. ..... 81/439
6,128,981 A * 10/2000 Bondhus et al. ..... 81/440
6,151,999 A * 11/2000 Eklind ..... 81/440
6,601,481 B2 * 8/2003 Chuang ..... 81/440
6,868,760 B1 * 3/2005 Johnson ..... 81/440
6,880,435 B2 * 4/2005 Hawkins ..... 81/440

* cited by examiner

*Primary Examiner*—D. S Meislin
(74) *Attorney, Agent, or Firm*—Muncy, Geissler, Olds & Lowe, PLLC

(57) ABSTRACT

An accommodating handle for hexagon spanner includes a box which is approximately a triangle and is assembled by an upper box and a lower box, wherein the three points of the triangle inside the lower box are respectively disposed a pillar, the three edges of the box are concaved inwardly to be arcs, a turning piece is mounted at the edge and one end of the turning piece is a pivoting end for pivoting on the box and the other end is a moving end having wedging points for wedging at the locations adjacent to the three points of the box, plural hexagon spanners in various sizes are sleeved on the pillar of the lower box in size sequence, and the three points of the box are respectively mounted an indentation for penetrating the working end of the hexagon spanners.

5 Claims, 6 Drawing Sheets

ACCOMMODATING HANDLE FOR HEXAGON SPANNER

FIELD OF THE INVENTION

The present invention is related to a handle of a hexagon spanner, and more particularly, to a handle of hexagon spanner which can accommodate hexagon spanners in various sizes.

BACKGROUND OF THE INVENTION

Traditionally, the hexagon spanner commonly found in the market, as shown in FIG. 1, always has an L shape, and because the hexagon spanner is used to insert into the hexagonal socket at the top of the screws for tightening or loosing thereof and the hexagonal sockets on the screws have various standards, the hexagon spanners are always sold in a set in which various sizes are included. Some are strung up by a metal circle, and others are packaged in a box, as shown in FIG. 2. However, utilizing a box to package the hexagon spanners actually is not easy for carrying and is easy to lose it. Further, since the hexagon spanner has an L shape and the user utilizes the short section to insert into the socket and the long section to hold and turn, the finer the hexagon the worse the handling. Therefore, the screw is not easy to be tightened and, on the other hand, the highly-tightened screw is not easy to be loosed.

Consequently, because of the technical defects of described above, the applicant keeps on carving unflaggingly through wholehearted experience and research to develop the present invention, which can solve the problems of accommodation and turn in the conventional hexagon spanner.

SUMMARY OF THE INVENTION

The object of the present invention is to provide an accommodating handle for the hexagon spanner, including a hollow box which has an approximate triangle shape and are assembled by an upper box and a lower box.

The three points of the triangle inside the lower box are respectively disposed a pillar upwardly, the three edges of the box are concaved inwardly to be arcs, a turning piece is respectively mounted at the edge and one end of the turning piece is a pivoting end for pivoting on the box and the other end is a moving end having wedging points for wedging at the locations adjacent to the three points of the box, one end of the hexagon spanner is a working end and the other end is bent as a hook for sleeving on the pillar of the lower box, and the three points of the box are respectively mounted an indentation for penetrating the working end of the hexagon spanners. Therefore, the handle having accommodation for plural hexagon spanners and holding purpose are provided.

Another object of the present invention is to provide a handle of hexagon spanner which shape provides the anti-slippery function and also conforms to the ergonomics for a convenient holding as turning.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1:
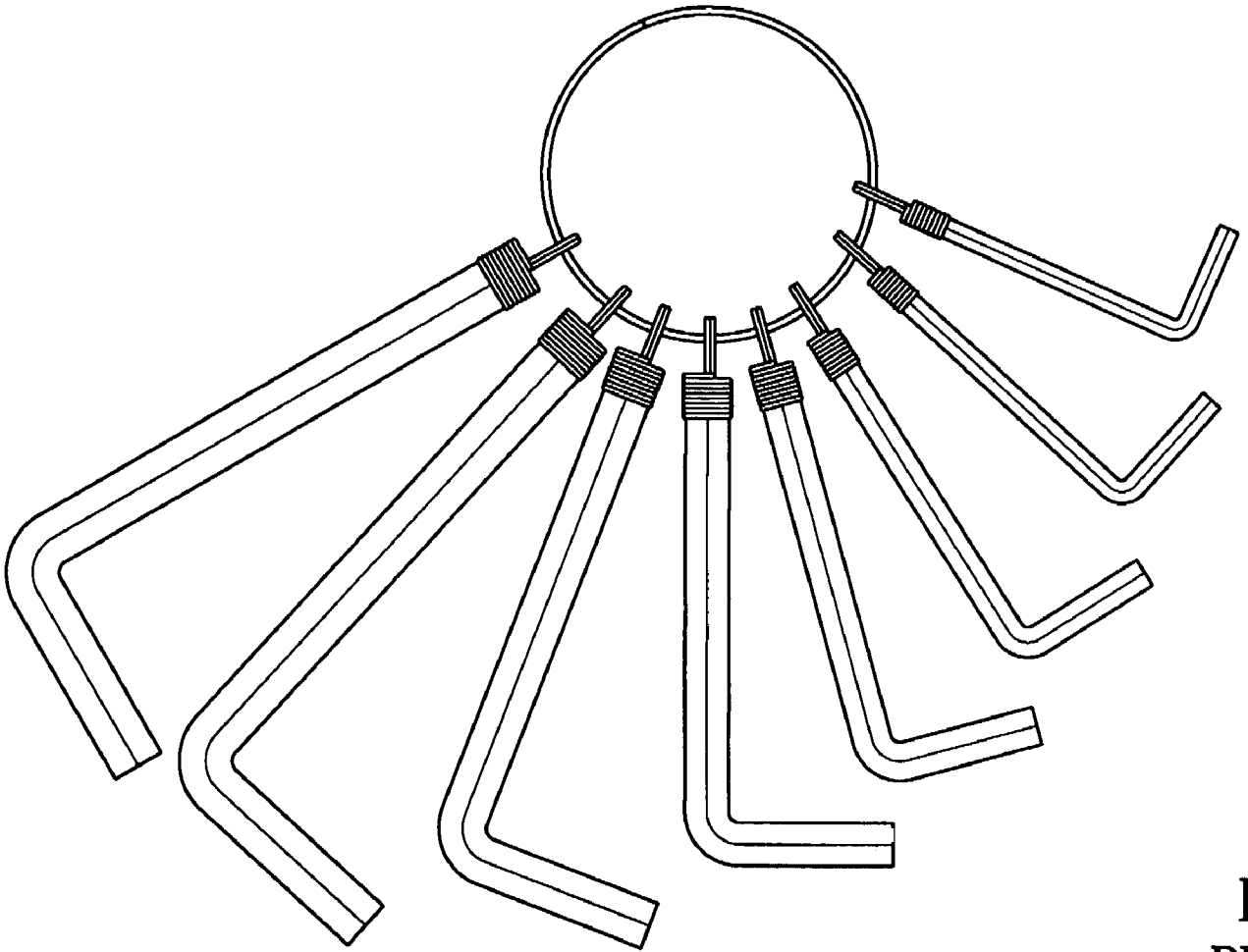
Fig. 1 PRIOR ART
FIG. 1 is a three-dimensional drawing showing the conventional hexagon spanners which are circled.
Figure 2:
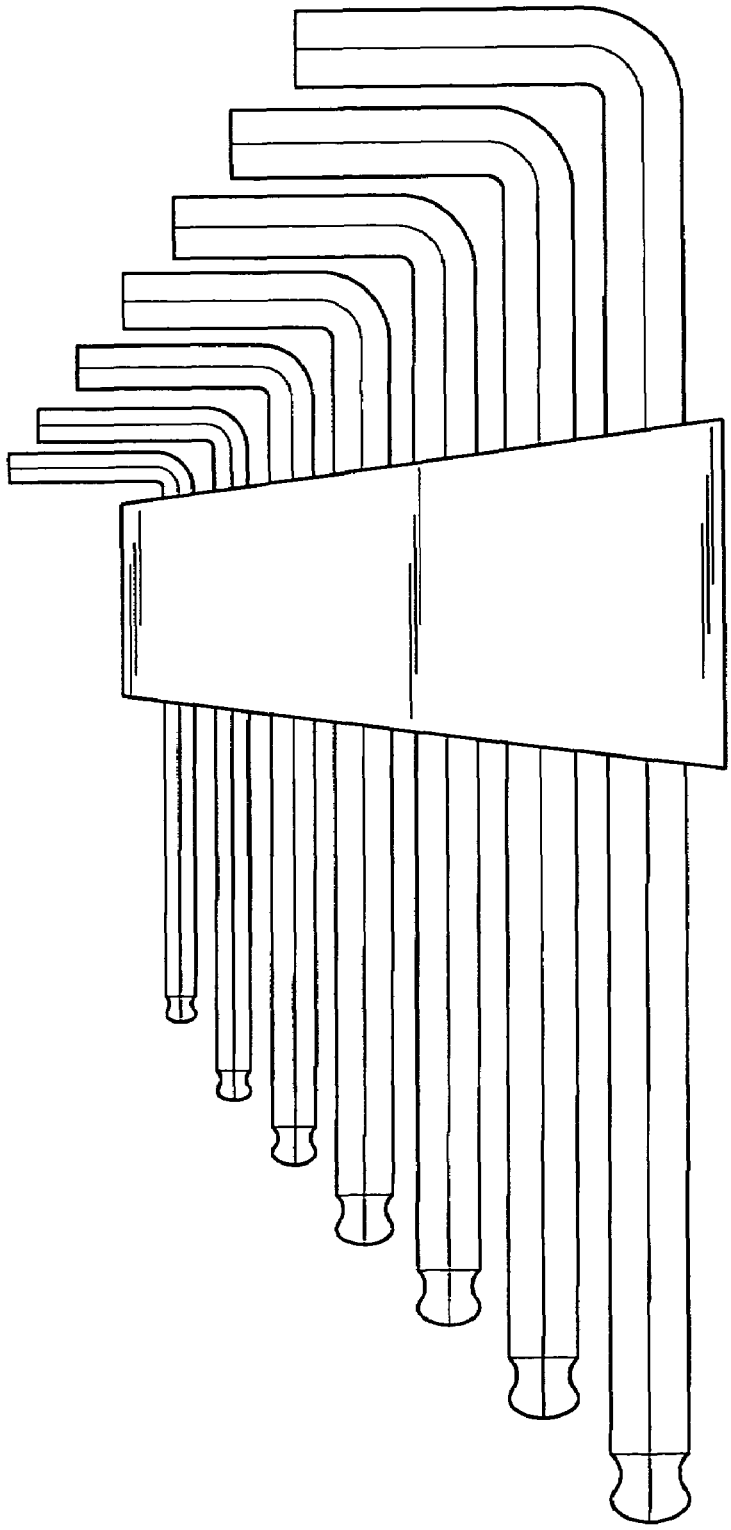
Fig . 2 PRIOR ART
FIG. 2 is a three-dimensional drawing showing the conventional hexagon spanners which are packaged in a box.
Figure 3:
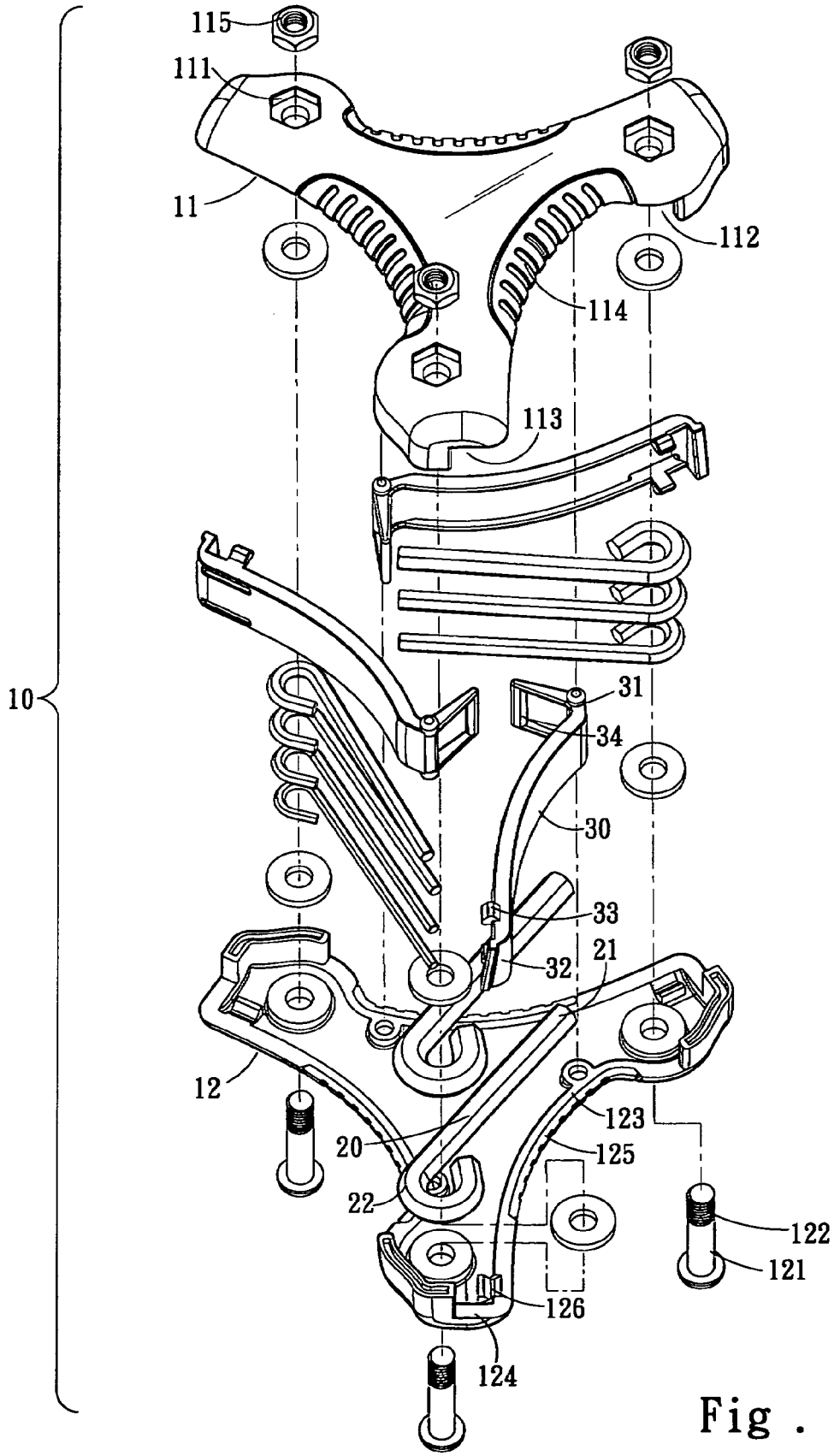
FIG. 3 is a three-dimensional decomposition drawing showing a preferred embodiment according to the present invention.

Please refer to FIG. 3, the present invention provides an accommodating handle for the hexagon spanner, which includes:

A hollow box 10, wherein the shape of the box 10 is approximately a triangle, in which the three edges thereof are inwardly concaved respectively to have an arc shape, the box 10 is assembled by an upper box 11 and a lower box 12, in which the three points of the triangle inside the lower box 12 are respectively disposed a pillar 121, whose top end has a thread section 122 thereon, the three edges of the lower box 12 respectively have a slot 123 at the outside and have an indentation 124 adjacent to the three points, the three edges of the lower box 12 vertically have an arc design and have anti-slippery lines 125 mounted thereon at the middle section thereof, and a wedging slot 126 is located at one end of the slot 123 adjacent to the indentation 124.

At the three points of the upper box 11, a countersink 111 is respectively mounted, a slot 112 is respectively mounted at the three edges of the upper box 11, an indentation 113 is respectively mounted at the outer side of the three points, the three edges of the upper box 11 vertically have arc design and have anti-slippery lines 114 located at the middle section thereof, a wedging slot (not shown) is located at one end of the slot 112 adjacent to the indentation 113, and the wedging slot is opposite to the wedging slot 126 of the lower box 12.

Plural hexagon spanners 20 in various sizes, one end of the hexagon spanners 20 is the working end 21 and the other end is bent as a hook 22 sleeved on the pillar 121 of the lower box 12.

Three turning pieces 30, each turning piece 30 is formed in accordance with the arc of the edge of the box 10 and is mounted at the positions of the slots 112, 123 of the upper and the lower boxes 11, 12, one end of the turning piece 30 is a pivoting end 31 formed as a post and the upper and the lower portions of the pivoting end 31 are pivoted on the upper box 11 and the lower box 12 for turning, and the other end of the turning piece 30 is an moving end 32 for being turned out by hand and the upper and the lower portions of the moving end 32 are mounted a pair of wedging points 33, the wedging points 33 are located at the inner side of the turning piece 30 and are respectively wedged in the wedging slots 126 of the upper box 11 and the lower box 12, the pivoting end 31 of the turning piece 30 has a poking-out portion 34 as a ring, and the poking-out portion 34 and the turning piece 30 exactly constitute an L shape.

Three locking elements (such as the nut) 115, the locking elements 115 are located at the countersink 111 for locking on the thread portion 122 of the pillar 121 on the lower box 12.

Figure 5:
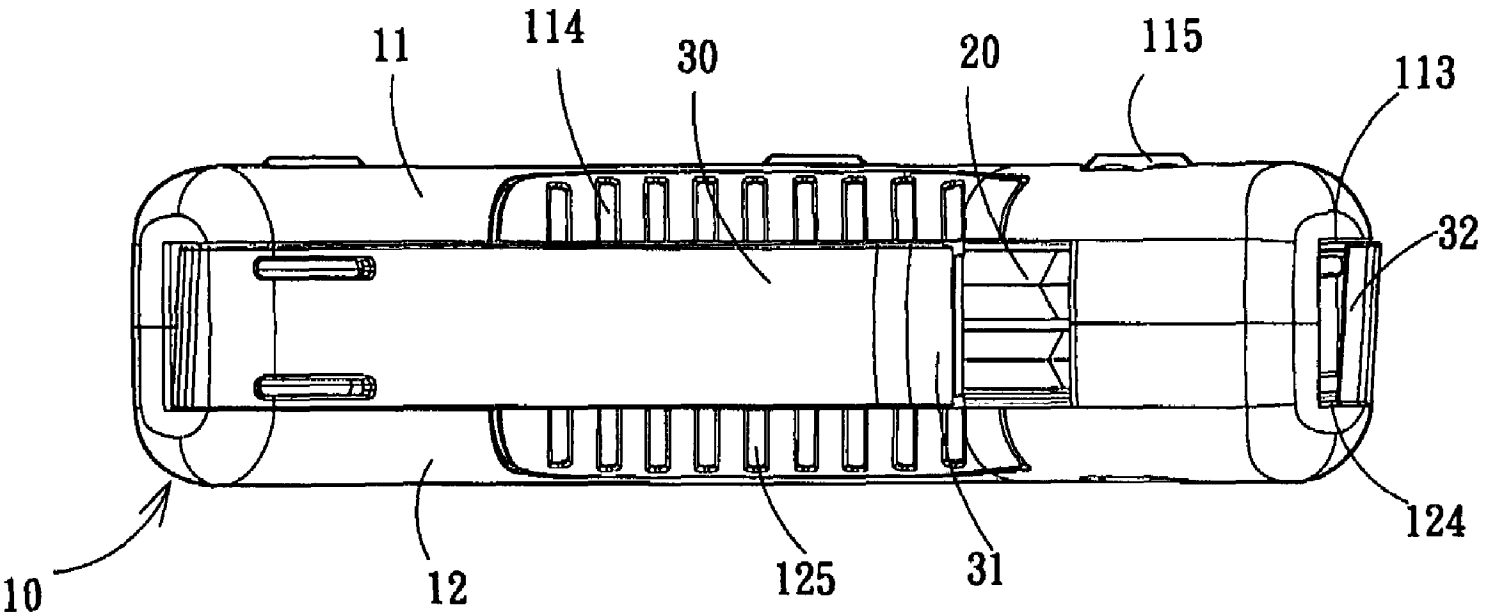
FIG. 5 is a side view showing a preferred embodiment according to the present invention.

Through the structure described above, the hexagon spanners 20 in various sizes are respectively, through the hook portion 22 thereof, sleeved on the pillars 121 of the lower box 12, the working ends 21 of the hexagon spanners 20 are exactly located at the inner side of the adjacent turning piece 30, and then the upper box 11 is assembled on the top of the lower box 12 for penetrating the pillars 121 inside the lower box 12 through the countersinks 111 of the upper box 11 so as to lock the locking elements 115, so that the upper box 11 and the lower box 12 are assembled to be an integration, as shown in FIG. 5.

Figure 4:
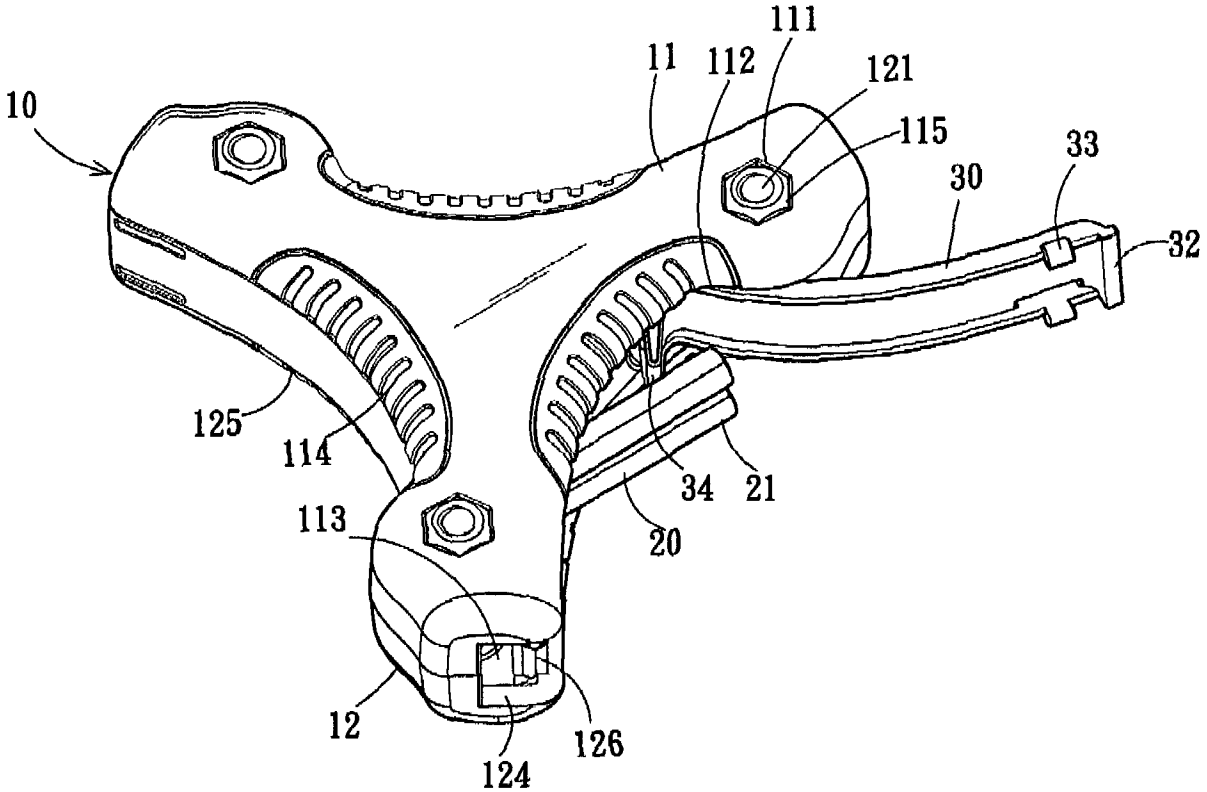
FIG. 4 is a schematic view showing the first action of a preferred embodiment according to the present invention.
Figure 6:
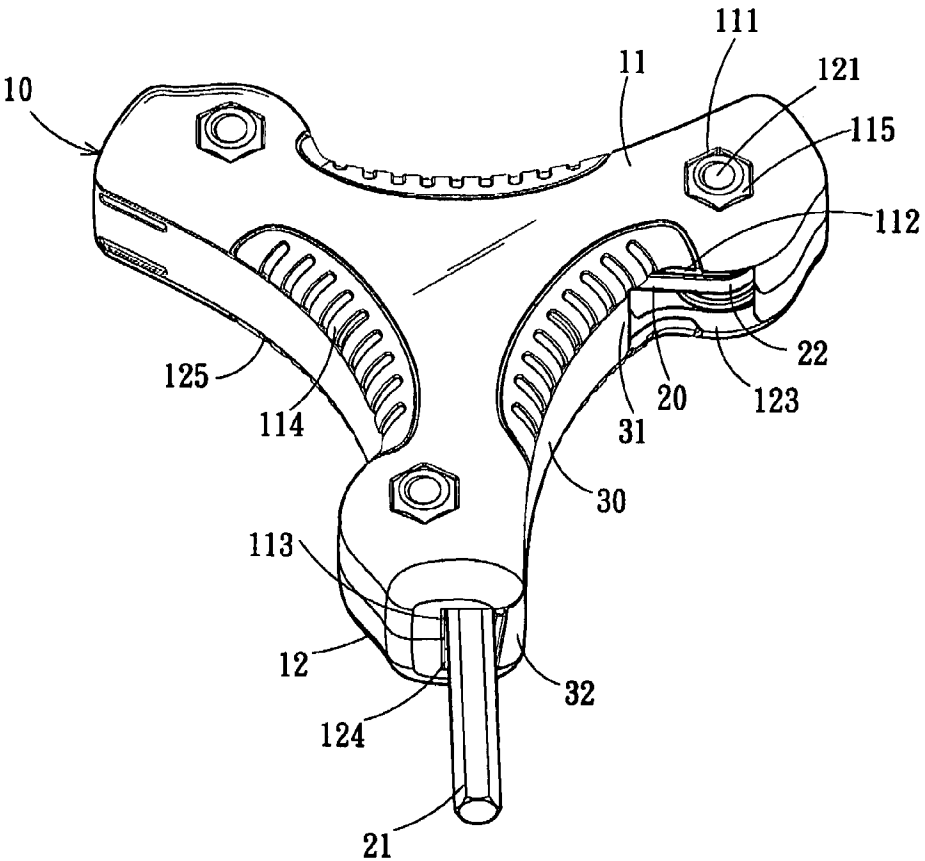
FIG. 6 is a schematic view showing the second action of a preferred embodiment according to the present invention.

When using, as shown in FIGS. 4 and 6, through the finger, the moving end 32 of the turning piece 30 is turned out for exposing the target hexagon spanner 20 and the poking-out portion 34 can be poked out for moving out the working end 21 of the hexagon spanner 20, and then the target hexagon spanner 20 is pulled out for penetrating through the indentations 113, 124 of the upper and the lower boxes 11, 12 and exposing the working end 21, so that the user can hold the box 10 to turn the box 10 for driving the working end 21 of the hexagon spanner 20 at the outside to tighten or loose the screw.

It should be noted that, in the present invention, the three edges of the box 10 are all formed to be concave inwardly so as to have all an arc design, and along the arc edges, there are anti-slippery lines 114, 125 are mounted thereon for providing the anti-slippery function when turning the spanner. Besides, the shape of the box 10 also conforms to ergonomics for convenient holding.

The present invention is advantageous that the box 10 can accommodate hexagon spanners 20 in various sizes in the inner space thereof, and when using, the user only needs to poke out the moving end 32 of one turning piece 30 for pulling out the working end 21 of the target hexagon spanner 20 so as to tighten or loose the screw. Furthermore, the shape of the box 10 is an equilateral triangle and each edge is inwardly concaved and has anti-slippery lines 114, 125 mounted thereon, so that the hexagon spanner 20 can be easily moved out and the box 10 is suitable for holding by the thumb and the other four fingers.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An accommodating handle for hexagon spanner, comprising:

a box, wherein the box is a hollow triangle, whose three edges are concaved inwardly to be arcs, and is assembled by an upper box and a lower box, wherein:

the three points of the triangle inside the lower box are respectively disposed a pillar, the three edges of the lower box respectively have a slot at an outside thereof and have an indentation adjacent to the three points;

the three points of the upper box has a countersink respectively mounted thereon, and the three edges of the upper box respectively have a slot and have an indentation respectively adjacent to the three points;

plural hexagon spanners in various sizes, wherein one end of the hexagon spanners is the working end and the other end is bent as a hook sleeved on the pillars of the lower box;

three turning pieces, wherein each turning piece is formed in accordance with the arc of the edge of the box and is mounted at the positions of the slots of the upper and the lower boxes, one end of the turning piece is a pivoting end formed as a post and the upper and the lower portions of the pivoting end are pivoted on the upper box and the lower box for turning, and the other end of the turning piece is a moving end; and three locking elements, which are located at the countersink for locking on the pillar on the lower box.

2. The accommodating handle for hexagon spanner as claimed in claim 1, wherein a pair of wedging points are mounted at the upper and lower positions of the moving end of the turning pieces and a pair of wedging slots are mounted at one end of the slots of the upper and the lower boxes, in which the wedging slots are provided for wedging the wedging points.

3. The accommodating handle for hexagon spanner as claimed in claim 1, wherein a thread section is mounted at the top of the pillar of the lower box and the locking element is a nut for locking on the thread section.

4. The accommodating handle for hexagon spanner as claimed in claim 1, wherein the edges of the lower box vertically have arc design and have anti-slippery lines mounted thereon.

5. The accommodating handle for hexagon spanner as claimed in claim 1, wherein the edges of the lower box vertically have arc design and have anti-slippery lines mounted thereon.

* * * * *